US005967513A

United States Patent [19]

Wells

[11] Patent Number: 5,967,513

[45] Date of Patent: Oct. 19, 1999

[54] SPORT BOARD GAME AND METHOD OF PLAYING SAME

[76] Inventor: Jack A. Wells, 816 15th Ave. NE., St. Petersburg, Fla. 33704

[21] Appl. No.: 09/129,071

[22] Filed: Aug. 3, 1998

[51] Int. Cl.[6] ..... A63B 67/10

[52] U.S. Cl. ..... 273/108.1; 273/108.4; 273/129 W; 273/317.3; 273/317.5; 273/329; 273/330; 273/331

[58] Field of Search ..... 273/108.1, 108.4, 273/129 R, 129 W, 317.1, 317.3, 317.5, 108, 329, 330, 331

[56] References Cited

U.S. PATENT DOCUMENTS 1,922,904 8/1933 Warren .
2,722,211 11/1955 Eisele .
2,828,964 4/1958 Horton .
3,888,485 6/1975 Conti .
4,550,911 11/1985 Daley .

*Primary Examiner*—Raleigh W. Chiu
*Attorney, Agent, or Firm*—Larson & Larson, P.A.; James E. Larson

[57] ABSTRACT

A flat board has a top side and a distal and proximal end. Mounted on the flat board top side at the distal end is a target area defined by a goal element. Mounted on the flat board top side at the proximal end is a launching mechanism. A base member of the launching mechanism has first and second channels formed therein. The second channel receives a handle portion of a launch spoon. The first channel receives a first end of a string. A second end of the string attaches to a projectile. A spoon portion is provided with the launch spoon for holding the projectile therewithin. The game is played by first bending the launch spoon in a direction opposed from that of the goal element and thereafter releasing the launch spoon so that the projectile is propelled toward the goal element in hopes of having the projectile cross through the target area.

15 Claims, 4 Drawing Sheets

SPORT BOARD GAME AND METHOD OF PLAYING SAME

BACKGROUND OF THE INVENTION

1. Field of the Invention

This invention relates to a game of skill. More particularly, it relates to a game of skill played on a small board, wherein the board resembles the professional game of football, baseball or basketball.

2. Description of Prior Art

In the prior art, games of skill are known. However, Applicant is unaware of any such game including all of the features and aspects of the present invention. The following prior art is known to Applicant:

U.S. Pat. No. 1,922,904 to Warren

U.S. Pat. No. 2,722,211 to Eisele

U.S. Pat. No. 2,828,964 to Horton

U.S. Pat. No. 3,888,485 to Conti

U.S. Pat. No. 4,550,911 to Daley

The present invention distinguishes from the teachings of these patents, taken alone or in combination with one another, as contemplating a novelty game of skill resembling one of many popular professional sports—namely, football, baseball and basketball—wherein a miniature field or court is provided having a goal at one end and a launching mechanism at the opposed end whereby a user launches a ball like element at the goal to score points.

SUMMARY OF THE INVENTION

The present invention relates to a novelty sport board game. The present invention includes the following interrelated objects, aspects and features:

(1) In a first aspect, the inventive game includes a board made to resemble either a football or baseball field or basketball court.

(2) The field or court has a goal element at a distal end of the field or court, represented by a goal post, home-run wall or basket, respectively.

(3) At a proximal end is a permanently mounted structure representing a ball of the respective game. The ball has a slot formed therein for receiving a handle of a launching mechanism. The launching mechanism also includes a spoon portion which holds a projectile. A string is attached to the projectile at one end and to the permanently mounted structure at an opposed end.

(4) In the preferred embodiment, the field resembles a football field, the target is a football goal post mounted at a far edge of the of distal end and the permanently mounted structure resembles a football.

As such, it is a first object of the present invention to provide a novelty sport board game.

It is a further object of the present invention to provide such a game wherein the board resembles either a football field, a baseball field or a basketball court.

It is a still further object of the present invention to provide such a game wherein a mounted structure at a proximal end permits a launching mechanism to be attached thereto for launching a projectile at a goal.

It is a still further object of the present invention to provide such a game wherein the goal resembles either a football goal post, a baseball home-run wall or a basketball hoop and net depending on which professional sport is being represented.

These and other objects, aspects and features of the present invention will be better understood from the following detailed description of the preferred embodiment when read in conjunction with the appended drawing figures.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
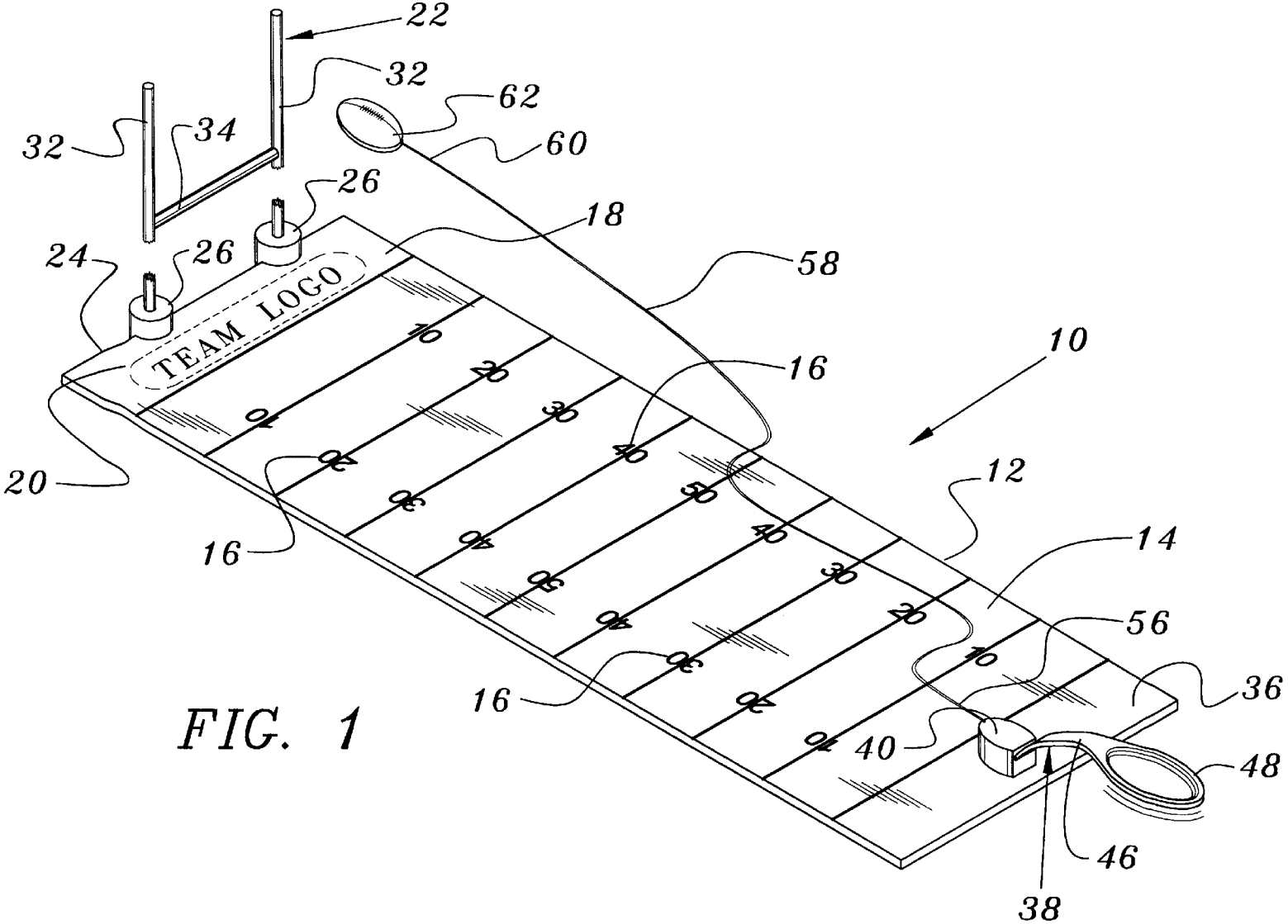
FIG. 1 is a perspective view of the preferred embodiment of a novelty sport board game of the present invention.
Figure 2:
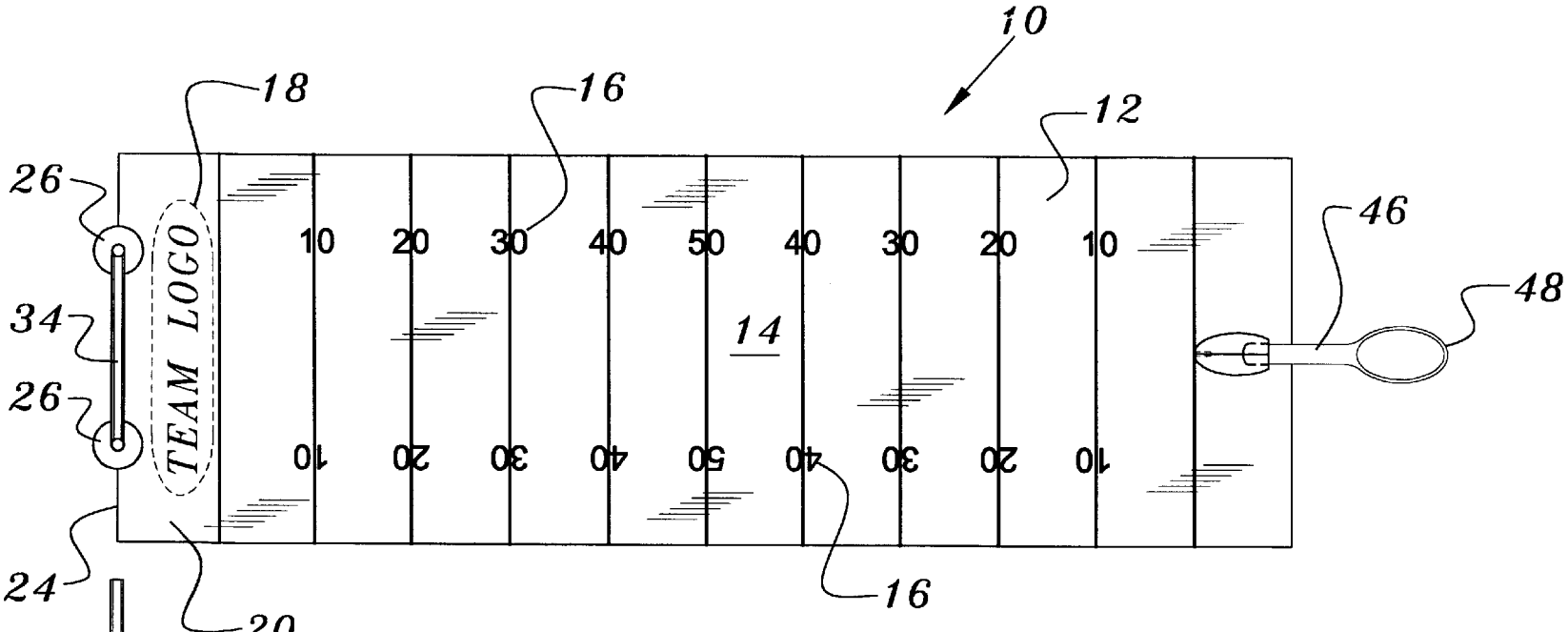
FIG. 2 is a top plan view of the preferred embodiment of the novelty sport board game.

Throughout the following detailed description, the same reference numerals refer to the same elements in all figures.

Figure 9:
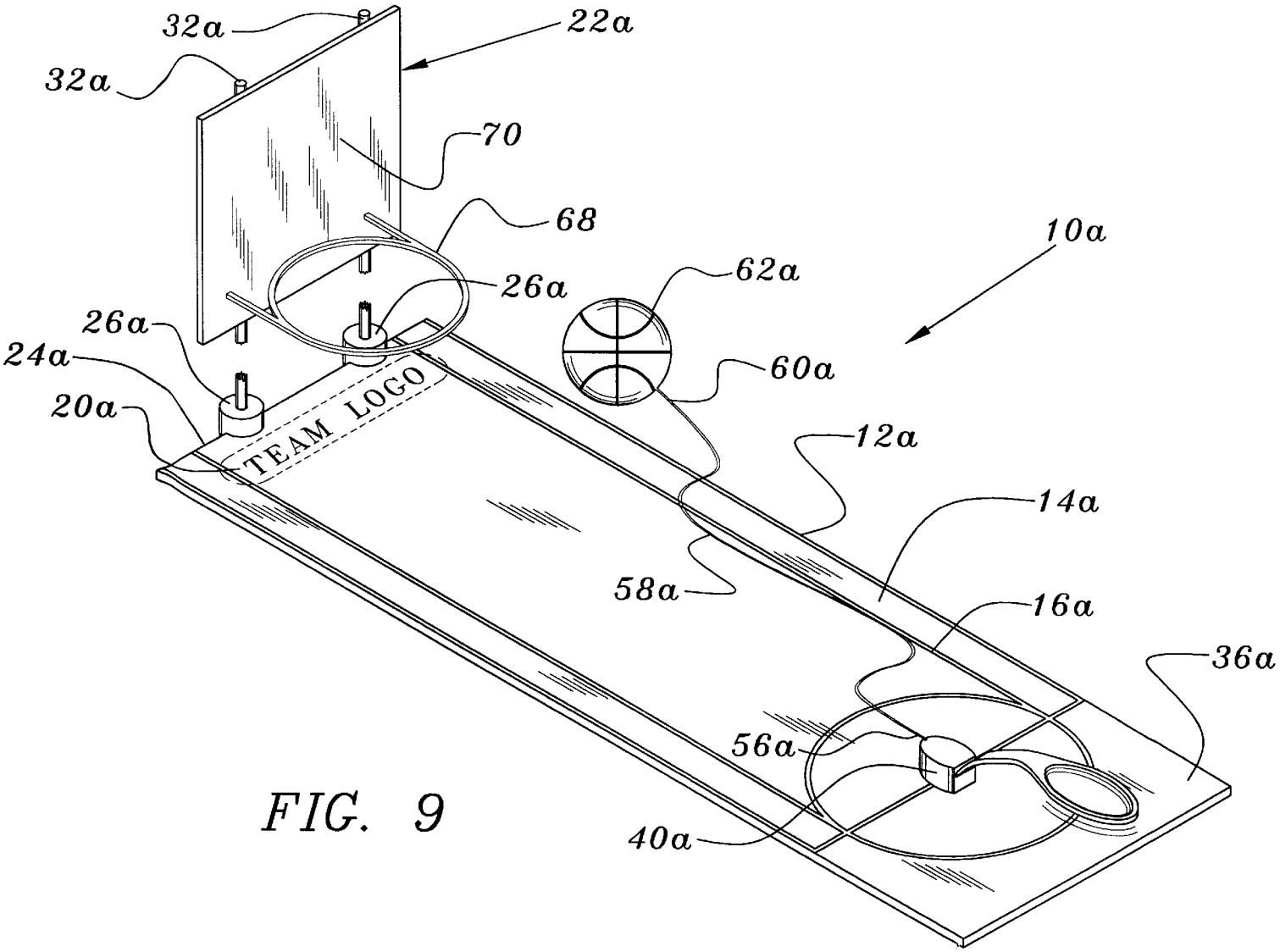
FIG. 9 is a perspective view of an alternate embodiment of a novelty sport board game of the present invention.

Referring to FIG. 1, a novelty sport board game 10 is shown. Board game 10 includes a flat board 12 representing a football field (the preferred embodiment). In alternate embodiments, either a baseball field or a basketball court (see FIG. 9) is employed. On a top side 14 of flat board 12 are graphic representations 16 of the respective field or court. For instance, in the preferred embodiment, as shown in FIG. 1, flat board 12 has a graphic representation 16 of a football field printed on top side 14 of flat board 12. Additionally, a logo area 18 can be employed for adhering the logo of any of the known sport team logos. In the preferred embodiment of FIG. 1, logo area 18 is positioned along flat board 12 at a distal end 20 in an area representative of a football field end zone.

Figure 7:
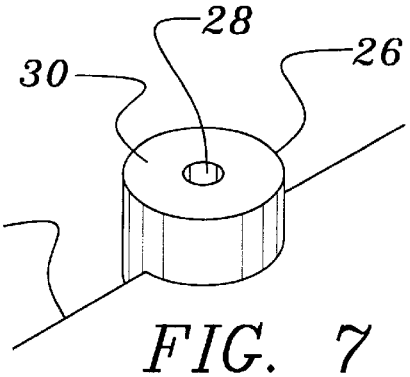
FIG. 7 is a perspective view of an anchoring means used to receive a goal element in the present invention.
Figure 5:
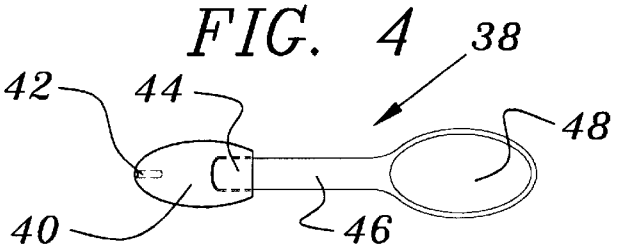
FIG. 5 is a top plan view of a projectile launching mechanism used in the present invention.

With further reference to FIG. 1, a goal element 22 is provided at flat board distal end 20. Goal element 22 is mounted to an edge 24 of distal end 20 by an anchoring means. In the preferred embodiment, as seen in FIG. 1, the anchoring means is a pair of integrally attached discs 26. Referring to FIG. 7, each disc 26 has a center channel 28 formed through a top surface 30 of disc 26.

Figure 8:
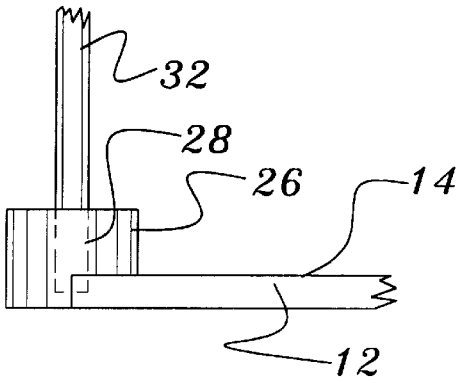
FIG. 8 is a side elevational view of the anchoring means depicting how it receives the goal element in the preferred embodiment of the present invention.

As seen in FIG. 1, discs 26 receive goal element 22. In particular to the preferred embodiment, goal element 22 includes a pair of parallel posts 32 having an attachable perpendicular cross-bar 34 disposed therebetween such that goal element 22 resembles a football goal post. With reference to FIG. 8, each center channel 28 of each disc 26 receives one of the two parallel posts 32 thereby mounting goal element 22 to flat board 12 such that the pair of parallel posts 32 are perpendicular to flat board top side 14 and cross-bar 34 is parallel to flat board top side 14 (see FIG. 1).

Figure 6:
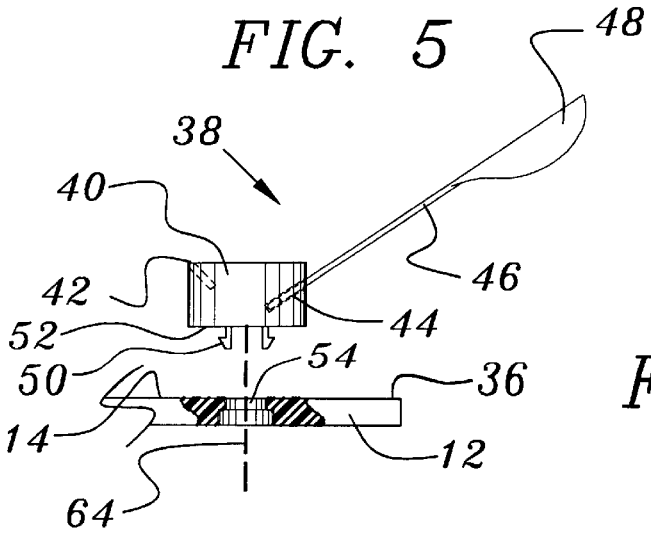
FIG. 6 is a side elevational view, partially in section, of the projectile launching mechanism, depicting how it mounts to the board in the preferred embodiment.

As shown in FIG. 1, a projectile launching mechanism 38 is provided at a proximal end 36 of flat board 12. Referring to FIG. 6, projectile launching mechanism 38 includes a base member 40 having first and second opposed channels 42 and 44 respectively, formed at generally forty-five degree angles, in respect to flat board top side 14. Second channel 44 receives a handle portion 46 of a launch spoon 48. In the preferred embodiment, fixed member 40 is mounted to flat board 12 by inserting a pair of spring legs 50, extending downwardly from a bottom portion 52 of fixed member 40, into an aperture 54 formed through flat board proximal end 36 (see FIG. 6).

Referring to FIG. 1, a first end 56 of a string 58 inserts into first channel 42, affixing string 58 to base member 40 at first end 56, while a second end 60 of string 58 attaches to a projectile 62.

To play the game in the preferred embodiment, a user places projectile 62 in launch spoon 48. Handle portion 46, being made of a resilient material, is bent in a direction away from goal element 22, as seen in FIG. 1. The user releases handle portion 46 and which causes launch spoon 48 to return to a relaxed state thereby propelling projectile 62 towards goal element 22. The purpose of the game is to take proper aim prior to propelling projectile 62 such that projectile 62 crosses over cross-bar 34 and through the pair of parallel posts 32—an area defined as the target.

Figure 3:
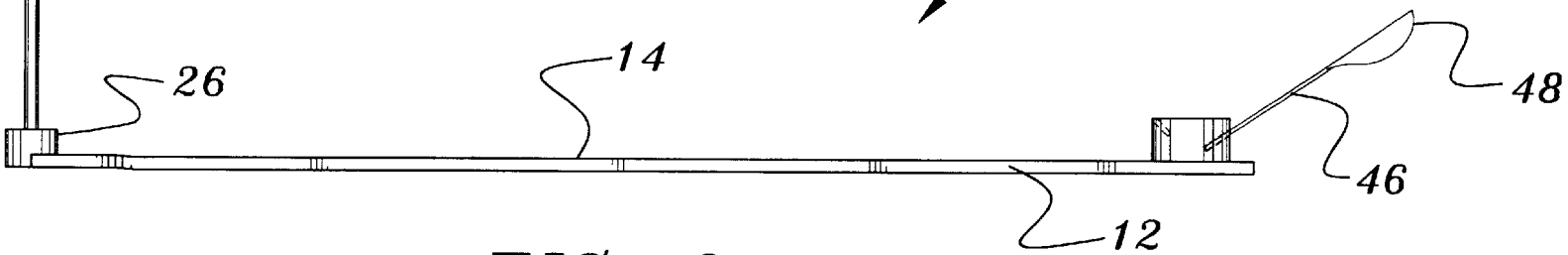
FIG. 3 is a left side elevational view of the preferred embodiment of the novelty sport board game.
Figure 4:
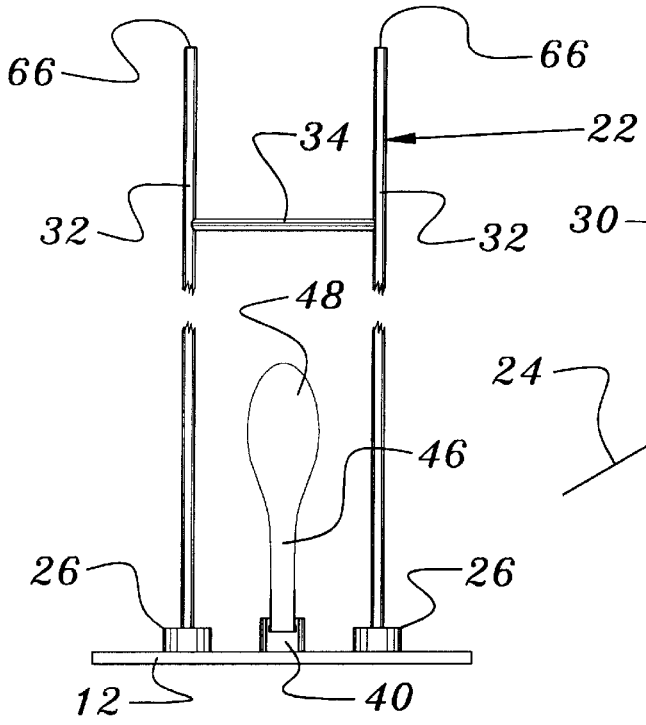
FIG. 4 is a front side elevational view of the preferred embodiment of the novelty sport board game.

In the preferred embodiment, wherein the game of football is represented, flat board 12 is made of plastic, is rectangular in shape, and is 12" long by 4" wide by ¾" thick. Base member 40, also made of plastic, is mounted to flat board 12 such that a center axis 64 (see FIG. 6) is axially aligned with a center axis of aperture 54 (not shown) formed through flat board proximal end 36. Further, depending on the sport represented, fixed member is generally shaped like the ball used in the respective sport. Hence, in the preferred embodiment, base member 40 is generally shaped like a football and stands about 2" tall. Goal element 22 is also made of plastic in the preferred embodiment and is detachable such that cross-bar 34 inserts within apertures (not shown) in the pair of parallel posts 32. Cross-bar 34 is 2" long and is spaced 8" above flat board top side 14. The pair of parallel posts 32 stand 10" high; therefore cross-bar 34 is positioned 2" from a top portion 66 of the pair of parallel posts (note that due to the preferred embodiment dimensions, FIGS. 1, 3 and 4 depict the pair of parallel posts 32 in a broken configuration to remain consistent with the other dimensions depicted in those same figure numbers). Parallel posts 32 and cross-bar 34 are preferably tubular in shape and have a ¼" diameter. Handle portion 46 and launch spoon 48 are also made of plastic in the preferred embodiment. It is advantageous to use a plastic which is capable of repetitive strain so that it does not fracture or break. Also to the preferred embodiment, projectile 62 is made of plastic and generally shaped to represent the ball used in the respective sport. Hence, in the preferred embodiment, projectile 62 is generally shaped like a football and is 1" long. String 58 can be made form any known material used to fabricate string and is preferably 14" long.

Although not shown, the invention of the present invention can employ a scoring means. Such scoring means could be integrally attached to flat board 12 (for instance a peg board system attached along one of the long side edges) or may be separately provided.

Although the preferred embodiment contemplates a board representing a football field, alternate embodiments can be employed to represent other sports. For example, a baseball field or a basketball court could be employed for flat board 12.

In the baseball field alternate embodiment (not shown), the board would be shaped to incorporate a diamond shaped baseball field. A graphic representation would be employed on a top side of the flat board to represent the infield and outfield of the field. The goal element would include a home run wall at a distal end of the board in which a projectile would be propelled towards. The home run wall goal element could be mounted to a far edge of the distal end in the same manner as in the preferred embodiment such that leg portions of the home run wall goal element would be received by a plurality of discs having a center channel formed therein. The base member would be mounted in the same manner as in the preferred embodiment and positioned near a point representing home plate on the baseball field. The base member and the projectile would resemble a baseball.

In the basketball court alternate embodiment 10*a* (see FIG. 9), the board 12*a* would be shaped to incorporate a rectangular shaped basketball court. A graphic representation 16*a* would be employed on a top side 14*a* of flat board 12*a* to represent the basketball court. The goal element 22*a* would include a basketball hoop 68 and backboard 70 positioned at a distal end 20*a* of board 12*a* in which a projectile 62*a* would be propelled theretowards. The hoop goal element 22*a* could be mounted to a far edge 24*a* of the distal end in the same manner as in the preferred embodiment such that a pair of parallel posts 32*a* would be received by a pair of discs 26*a* having a center channel formed therein. The pair of parallel posts 32*a* supports backboard 70. The base member 40*a* would be mounted in the same manner as in the preferred embodiment and positioned at a proximal end 36*a* of the court opposed from the hoop goal element 22*a*. The projectile 62*a* would resemble a basketball. A string 58*a* attaches at a first end 56*a* to base member 40*a* and at a second end 60*a* to projectile 62*a*.

In both alternate embodiments, an area is designated for the application of a team logo. For instance, in the basketball court alternate embodiment, the logo could be applied directly beneath the hoop goal element. In the baseball alternate embodiment, the logo could be applied directly in front of the home run wall, the so called "warning track." Both alternate embodiments also contemplate the use of a scoring means which could be integrally attached to the flat board of each respective represented game or separately provided.

Equivalent elements and steps for playing the game can be substituted for the ones set forth above to achieve the same results in the same manner.

Having thus described the invention what is claimed and desired to be secured by Letters Patent is:

1. A novelty sport game comprising:

a flat board having a top side and a distal and proximal end, a projectile launching mechanism including a base member and a launch spoon, the base member having a pair of spring legs downwardly extending from a bottom portion of the base member and first and second channels formed in the base member, the launch spoon having a handle portion and a spoon portion, the pair of base member spring legs inserting into an aperture formed in the flat board at a point along the proximal end, the base member second channel for receiving the handle portion of the launch spoon, a goal element having a target and mounted at the flat board distal end, a projectile for propelling through the target of the goal element, and a string having first and second ends, the first end inserted and fixed within the base member first channel, the second end attached to the projectile, the string permitting the projectile to propel to a maximum distance slightly greater than the distance between the base member and the goal element.

2. The novelty sport game of claim 1, further comprising, a plurality of disc members attached along an edge of the flat board distal end, each disc member having a center channel formed therein, each center channel of each disc receiving and retaining a tubular post of the goal element.

3. The novelty sport game of claim 2, wherein two disc members are employed.

4. The novelty sport game of claim 3, wherein the goal element comprises a pair of parallel posts and a cross-bar attached therebetween such that the cross-bar is perpendicular to the pair of parallel posts, the pair of parallel posts each having a top and bottom portion, the bottom portion of each parallel post inserting within one of the two disc members such that the parallel posts are positioned perpendicular to the flat board top side and the cross-bar is positioned parallel to the flat board top side.

5. The novelty sport game of claim 4, wherein the target is an area defined between the pair of parallel posts above the cross-bar.

6. The novelty sport game of game 3, wherein the goal element comprises a pair of parallel posts, a circular ring and a flat backboard, the flat backboard supported by the pair of parallel posts, the circular ring attached to the backboard, the pair of parallel posts each having a top and bottom portion, the bottom portion of each parallel post inserting within one of the two disc members such that the parallel posts and the flat backboard are positioned perpendicular to the flat board top side and the circular ring is positioned parallel to the flat board top side.

7. The novelty sport game of claim 1, further comprising a graphic representation affixed to the flat board top side.

8. The novelty sport game of claim 7, wherein the graphic representation resembles a football field.

9. The novelty sport game of claim 7, wherein the graphic representation resembles a basketball court.

10. The novelty sport game of claim 1, wherein the flat board is rectangular in shape.

11. A novelty sport game comprising, a flat rectangular board having a top side and a distal and proximal end, a projectile launching mechanism including a base member and a resilient launch spoon, the base member having a pair of spring legs downwardly extending from a bottom portion of the base member and first and second channels formed in the base member, the resilient launch spoon having a handle portion and a concave spoon portion, the pair of base member spring legs inserting into an aperture formed in the flat board at a point along the proximal end, the base member second channel for receiving the handle portion of the launch spoon, a goal element including a pair of parallel posts and a cross-bar, the cross-bar attached between the pair of parallel posts such that the cross-bar is perpendicular thereto, the pair of parallel posts each having a top and bottom portion, the goal element mounted to an edge of the flat board distal end such that the parallel posts are positioned perpendicular to the flat board top side, a target area located between the parallel posts above the cross-bar, a projectile for propelling through the target area, the projectile launched from the spoon portion of the launch spoon, a string having first and second ends, the first end inserted and fixed within the base member first channel, the second end attached to the projectile, the string permitting the projectile to propel to a maximum distance slightly greater than the distance between the base member and the goal element, and means for securing the goal element to the flat board.

12. The novelty sport game of claim 11, further comprising a graphic representation affixed to the flat board top side.

13. The novelty sport game of claim 11, wherein the means for securing the goal element to the flat board is a pair of disc members attached along the edge of the flat board distal end, each disc member having a center channel formed therein for receiving and retaining the bottom portion of one each of the parallel posts.

14. The novelty sport game of claim 13, wherein each center channel is circular in shape and each parallel post is tubular in shape.

15. A method of playing a novelty sport game, the steps comprising, a) providing a rectangular shaped flat board having a top side and a distal and proximal end, b) providing a mounted projectile launching mechanism at the flat board proximal end, the projectile launching mechanism including a base member and a resilient launch spoon, the launch spoon including a handle portion and an integral concave spoon portion, the base member including first and second channels formed therein at angles generally forty-five degrees from a horizontal plane of the flat board top side and opposed from each other, the second channel receiving and retaining the handle portion of the launch spoon, c) providing a mounted goal element at the flat board distal end, the goal element having a target area, d) providing a projectile for propelling through the target area, the projectile attached to the base member by a string, the string having first and second ends, the first end inserted and fixed within the base member first channel, the second end attached to the projectile, e) placing the projectile in the concave spoon portion of the launch spoon, f) bending the resilient launch spoon in a direction away from the goal element, and g) releasing the launch spoon thereby permitting the projectile to propel towards the target area of the goal element.

* * * * *